US005273458A

United States Patent [19]

Fisher, Jr. et al.

[11] Patent Number: 5,273,458

[45] Date of Patent: Dec. 28, 1993

[54] METHOD AND APPARATUS FOR CRIMPING AN ELECTRICAL TERMINAL TO A COAXIAL CABLE CONDUCTOR, AND TERMINAL AND COAXIAL CABLE CONNECTOR THEREFOR

[75] Inventors: Robert L. Fisher, Jr., Palmyra; Robert C. Hosler, Sr., Marysville, both of Pa.

[73] Assignee: The Whitaker Corporation, Wilmington, Del.

[21] Appl. No.: 988,087

[22] Filed: Dec. 4, 1992

[51] Int. Cl.[5] ..... H01R 17/04

[52] U.S. Cl. ..... 439/585

[58] Field of Search ..... 439/578-585, 439/675, 901, 904, 905

[56] References Cited

U.S. PATENT DOCUMENTS

| | | | |
|---|---|---|---|
| 3,671,922 | 6/1972 | Zerlin et al. | 439/578 |
| 3,694,793 | 9/1972 | Concilman | 439/675 |
| 4,904,206 | 2/1990 | Laudig et al. | 439/578 |
| 4,917,630 | 4/1990 | Hubbard | 439/578 |
| 5,062,808 | 11/1991 | Hosler, Sr. | 439/580 |

OTHER PUBLICATIONS

*AMP Instruction Sheet IS* 7516, "AMP Screw-Machine Contacts and Application Tooling", Released Dec. 3, 1990, Sixteen pages; AMP Incorporated, Harrisburg, PA.

*AMP Instruction Sheet IS* 2348-2, "AMP Coaxicon Contacts", Revised Mar. 29, 1974, two pages; AMP Incorporated, Harrisburg, PA.

*AMP Instruction Sheet IS* 2987-3, "AMP Coaxial RF Series 50-Ohm and 75-Ohm Commercial SMB Bulkhead Jack Connectors", Released Aug. 20, 1991, three pages; AMP Incorporated, Harrisburg, PA.

*Military Specification Sheet MIL-C-22520/2C*, "Crimping Tools, Terminal, Hand; Wire Termination for Wire Barrel Sizes 20 through 28", dated Mar. 19, 1976, thirty-four pages; U.S. Department of Defense, Washington, DC.

*Daniels Data Sheet*, "Miniature Adjustable Crimp Tool AFM8 (M22520/2-01)", date unknown; Daniels Manufacturing Corporation, Orlando, FL.

*IEC Standard* 169-19, "Radio-Frequency Connectors, Part 19: R.F. Coaxial Connectors with inner diameter of outer conductor 2.08 mm (0.082 in) with snap coupling—Characteristic impedance 50 ohms (Type SSMB)", pages 5 to 18, (1985); International Electrotechnical Commission, Geneva, Switzerland.

*Primary Examiner*—David L. Pirlot

*Attorney, Agent, or Firm*—Anton P. Ness

[57] ABSTRACT

A method for crimping a terminal (30) to an end of an inner conductor (20) of a coaxial cable (10) so that the resulting crimp joint (22) is precisely located a selected distance rearwardly from a mating point of the contact section (32) with a complementary contact section of a mating terminal affixed to an other coaxial cable. The terminal includes an intermediate section (42) of selected length, reduced diameter and location between the body section (34) and the crimp joint (24), such that, in cooperation with a smaller diameter forward portion (218) of the bore of the connector outer shell (210) coextending therealong, a region of deliberate impedance mismatch results compensating for other mismatches of the coaxial connection for minimized overall mismatch. A locating fixture (100) affixed to crimping tool (50) has an aperture (102) includes a stop surface (130) which stops the terminal during insertion through the crimping port (56) of the crimping tool and into the aperture by abutting with a ledge (38) of terminal (30), resulting in a target portion (46) of the crimping barrel (40) being precisely opposed from the tool's reciprocating crimping dies (80,82) to be crimped. Mating connectors (202,302) are affixed to cables (200,300) containing the improved crimped terminals.

6 Claims, 8 Drawing Sheets

METHOD AND APPARATUS FOR CRIMPING AN ELECTRICAL TERMINAL TO A COAXIAL CABLE CONDUCTOR, AND TERMINAL AND COAXIAL CABLE CONNECTOR THEREFOR

FIELD OF THE INVENTION

The present invention relates to the field of electrical connectors and more particularly to coaxial cable connectors and termination of coaxial cable signal conductors with electrical terminals.

BACKGROUND OF THE INVENTION

Coaxial cables generally include an inner conductor for signal transmission, surrounded by an inner insulative layer around which is an outer conductor concentric with the inner conductor, and the cable also has an outer insulative jacket therearound. For enabling connection of the coaxial cable to a device, or to another coaxial cable, a connector is required which includes an inner contact or terminal mechanically and electrically connected to an end of the inner conductor, a dielectric sleeve therearound, and an outer conductor or contact which is mechanically and electrically connected to the shielding braid of the cable. Such mechanical and electrical connection of the inner and outer contacts of the connector to the inner and outer conductors of the cable must be made in such a way that minimizes impedance mismatch which otherwise would degrade the signal being transmitted. Such degradation is the result of discontinuities in the radial distance between the outer surface of the inner contact and the inner surface of the outer contact which generates reflections into the circuit, which discontinuities include changes in diameter in either contact or deformation of the metal and which is influenced by the distance of such diameter change from the mating interface with inner and outer contacts of a mating coaxial connector.

Commonly such mechanical and electrical connection of at least the signal or inner contact to the inner conductor is established by soldering the contact to an exposed end of the cable's inner conductor. As is typical of soldering operations generally, such procedures are time-consuming and are technique sensitive, in order to provide an assured solder joint; additionally, soldering is subject to outside influences which can affect the integrity of the resulting joint such as a layer of incremental corrosion upon one or both metal surfaces, and the freedom from impurities in the solder or flux or the assembly area. Further, inspection of the finished solder joint is required to provide visual verification of the quality of the joint, prior to completion of the process of affixing the connector to the cable end, whereafter the solder joint is hidden.

It is known to terminate the conductor of a wire, other than coaxial cable, by exposing a length of the conductor, inserting the exposed length into the wire-receiving barrel of an electrical terminal, and crimping the barrel to the wire by deforming the malleable metal radially inwardly under such pressure along a limited axial distance to in turn deform the malleable (usually high copper content alloy) metal of the conductor, creating compressively interfitting metal/metal formations defining a crimp joint which thereafter remains in such deformed condition with the metal of the terminal assuredly electrically connected to the metal of the conductor.

For example, see AMP Instruction Sheet IS 7516 dated Dec. 3, 1990 entitled "AMP Screw-Machine Contacts and Application Tooling." For coaxial cable terminals and connectors in particular, see AMP Instruction Sheet IS 2348-2 dated Mar. 29, 1974 and entitled "AMP COAXICON Contacts", and also AMP Instruction Sheet IS 2987-3 dated Aug. 20, 1991 entitled "AMP Coaxial RF Series 50-Ohm and 75-Ohm Commercial SMB Bulkhead Jack Connectors."

Tools are also known which perform the crimping operation, having dies which are pressed against the outside of the terminal barrel generally at several spaced circumferential locations therearound to deform the metal thereof radially inwardly. A variety of shapes of crimping dies are known which provide an optimum crimp joint for the particular gage of wire, the particular single-strand or multi-strand composition of the wire's conductor, the type of metal of the conductor and the terminal barrel, and the difference in diameters therebetween, and so on. One such tool is sold by Daniels Manufacturing Corp. under Part No. AFM8 (M22520/2-01).

Standards for such tools and a variety of positioner attachments is disclosed in Military Specification MIL-C-22520/2C dated Mar. 19, 1976. A particular positioner is selected according to the size terminal to be crimped, and is affixed to the crimping tool opposed from the crimping port into which the terminal will be placed, in such a manner that a terminal-receiving aperture is aligned with the crimping port to receive the terminal and thereafter hold it in position for wire end insertion and the crimping of the terminal to the wire end.

It is desired to provide a method of and apparatus for securing an electrical terminal to a coaxial cable's inner conductor which does not involve soldering.

It is further desired that such method reliably result in a mechanical and electrical connection which minimizes impedance mismatch.

It is additionally desired to provide a connector and terminal and apparatus especially suited for such method.

SUMMARY OF THE INVENTION

The present invention provides a method for crimping an electrical terminal to an exposed end of an inner conductor of a coaxial cable. The resulting crimped connection provides an assured electrical connection for signal transmission with minimal impedance mismatch being generated because of the necessary deformation of the metal of the conductor-receiving barrel of the terminal and the metal of the inner conductor. The region of the crimp is limited in axial length, in radial dimension and in placement with respect to the end of the contact section at the forward end of the terminal, all of which have an influence on the generation of impedance mismatch. A terminal especially suited for crimping to the cable's inner conductor is provided, and a coaxial connector for use with such terminal is also provided.

A manual crimping tool in commercial use provides the actual crimping, but the present invention provides a locating fixture for use with such a tool into which the contact section of the electrical terminal is inserted, with the inner conductor of the coaxial cable disposed within the conductor-receiving barrel of the terminal extending away from the tool. The locating fixture is adapted for the particular terminal desired to be crimped to the particular size coaxial cable. The locating fixture is mountable to the tool in a manner precisely referenced to the position of the crimping dies of the tool, and includes a profiled contact section-receiving bore of precise depth and diameter and profile that upon abutment of a precisely located stop shoulder with an annular collar of the terminal existing at a known location along the terminal, positions the conductor-receiving barrel of the terminal at a particularly desired axial location to be positioned opposed from the crimping dies which then upon crimping tool actuation crimp the barrel radially inwardly into the inner conductor at the particularly desired axial location. Use of such locating fixture precisely locates the crimping region axially with respect to the forward tip of the contact section, thus controlling precisely the location of the crimp deformation from the terminal-to-terminal mated interconnection extending along the contact section of the electrical terminal.

The signal terminal includes a forwardly facing ledge or stop surface precisely located to cooperate with the precisely profiled bore of the locating fixture to assure that the target region of the conductor-receiving barrel is opposed from the crimping dies to be crimped. The signal terminal also includes a reduced diameter intermediate section adjacent the forwardly facing stop surface and extending to the conductor-receiving barrel, with the intermediate section having an outer diameter and an axial length precisely selected to generate a deliberate impedance mismatch designed to compensate for other regions of impedance mismatch of the connector in order to result in an optimally minimized total connector impedance mismatch.

The connector includes an inner dielectric sleeve adapted to receive the signal terminal into a central passageway thereof after being crimped to the cable's inner conductor. The inner dielectric sleeve is held snugly between opposed annular ledges or retention surfaces of forward and rearward outer conductive shells, which are press fit together about the dielectric sleeve after insertion over the sleeve ends, by an annular flange of one shell extending axially to be received into a corresponding recess of the inner end of the other shell in a press fit. The rearward shell includes a reduced diameter crimping section extending axially from its outer end, for the exposed end of the shielding braid of the coaxial cable to be drawn thereover, after which a crimping ferrule is drawn over the braid to overlie the crimping section and then crimped.

It is an objective of the present invention to provide a method for assuring the crimping of a terminal to a coaxial cable inner conductor in a manner minimizing impedance mismatch and reflection during in-service signal transmission along the terminal to a mating terminal.

It is also an objective to provide such a method which is adaptable to available crimping tools through an improved positioner attachment for use therewith.

It is further an objective to provide such a method which not only is simple to perform but also minimizes sensitivity to technique variables in the performance of the method.

It is additionally an objective of the present invention to provide a terminal especially suited to being crimped to a coaxial cable inner conductor, which has an intermediate section of precisely selected diameter, location and axial length in relationship to the contact region and the crimping region to generate a deliberate impedance mismatch during in-service use selected to compensate for other impedance mismatch generated by the remainder of the coaxial cable connector, in order to provide overall minimized impedance mismatch for the total connection.

It is also an additional objective to provide a connector assembly especially suited for use with such a terminal crimped to a coaxial cable inner conductor.

An embodiment of the method of the present invention will now be described by way of example with reference to the accompanying drawings.

DETAILED DESCRIPTION OF THE PREFERRED EMBODIMENT

Figure 1:
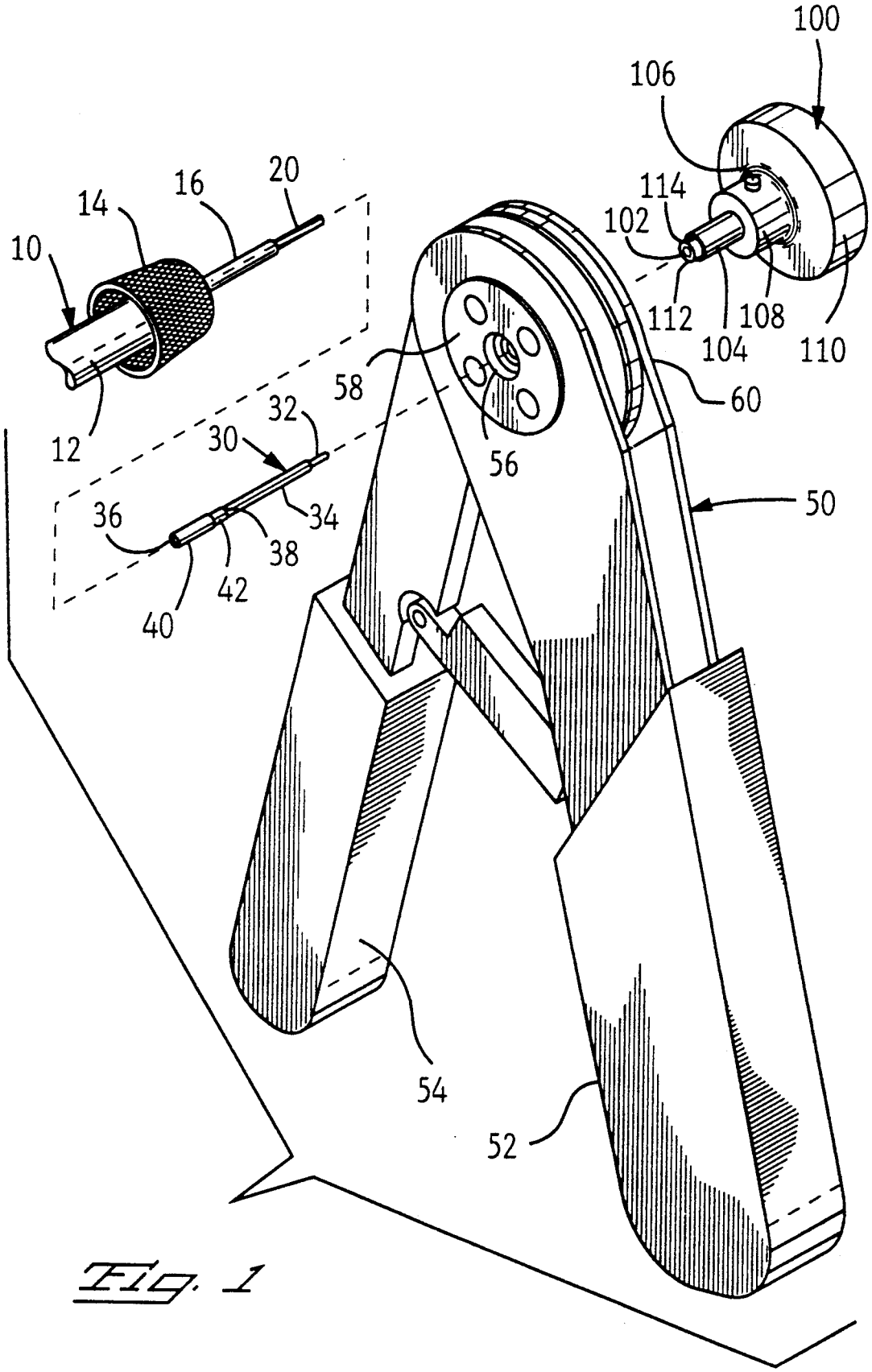
FIG. 1 is an isometric view of a prepared coaxial cable end, an electrical terminal for use therewith, and a crimping tool and locating fixture of the present invention.

FIG. 1 illustrates a coaxial cable 10 having an end thereof prepared to have a coaxial connector applied thereto with an electrical terminal 30 to be crimped to the inner conductor of the cable by the crimping tool 50, following the method of the present invention utilizing locating fixture 100. Coaxial cable 10 includes an outer jacket 12, a shielding braid 14, an inner insulative layer 16 and an inner conductor 20. A length of the outer jacket 12 has been removed in conventional manner, the length of shielding braid 14 thus exposed having been carefully folded back, and a shorter end length of inner insulative layer 16 removed exposing a selected length of the inner conductor 20.

Figure 2:
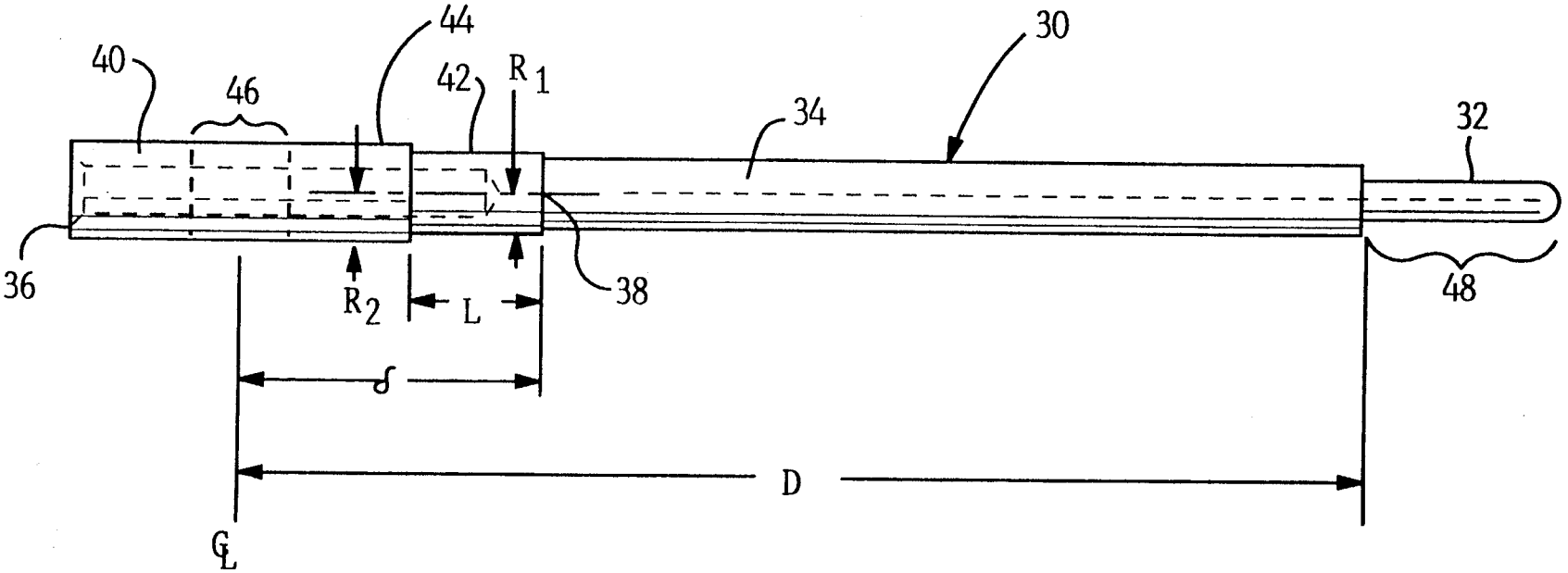
FIG. 2 is an elevation view of a terminal of the present invention to be crimped to a coaxial cable inner conductor.
Figure 3:
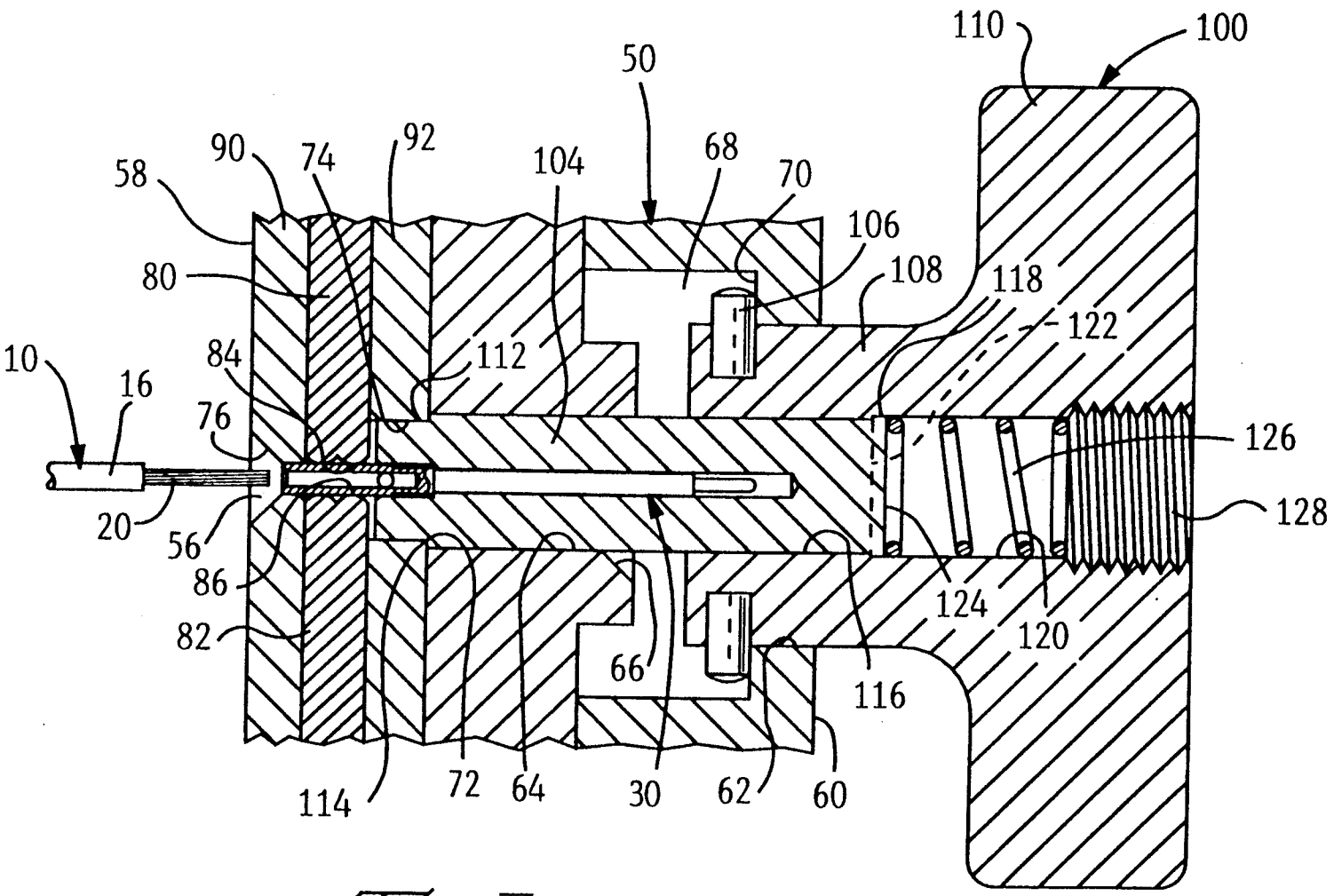
FIGS. 3 and 4 are longitudinal section views of a portion of the tool with the locating fixture mounted thereto, the terminal of FIG. 2 inserted therewithin, and the exposed end of the cable's inner conductor being inserted into the terminal, and being crimped by a set of crimping dies of the tool according to the method of the present invention.
Figure 4:
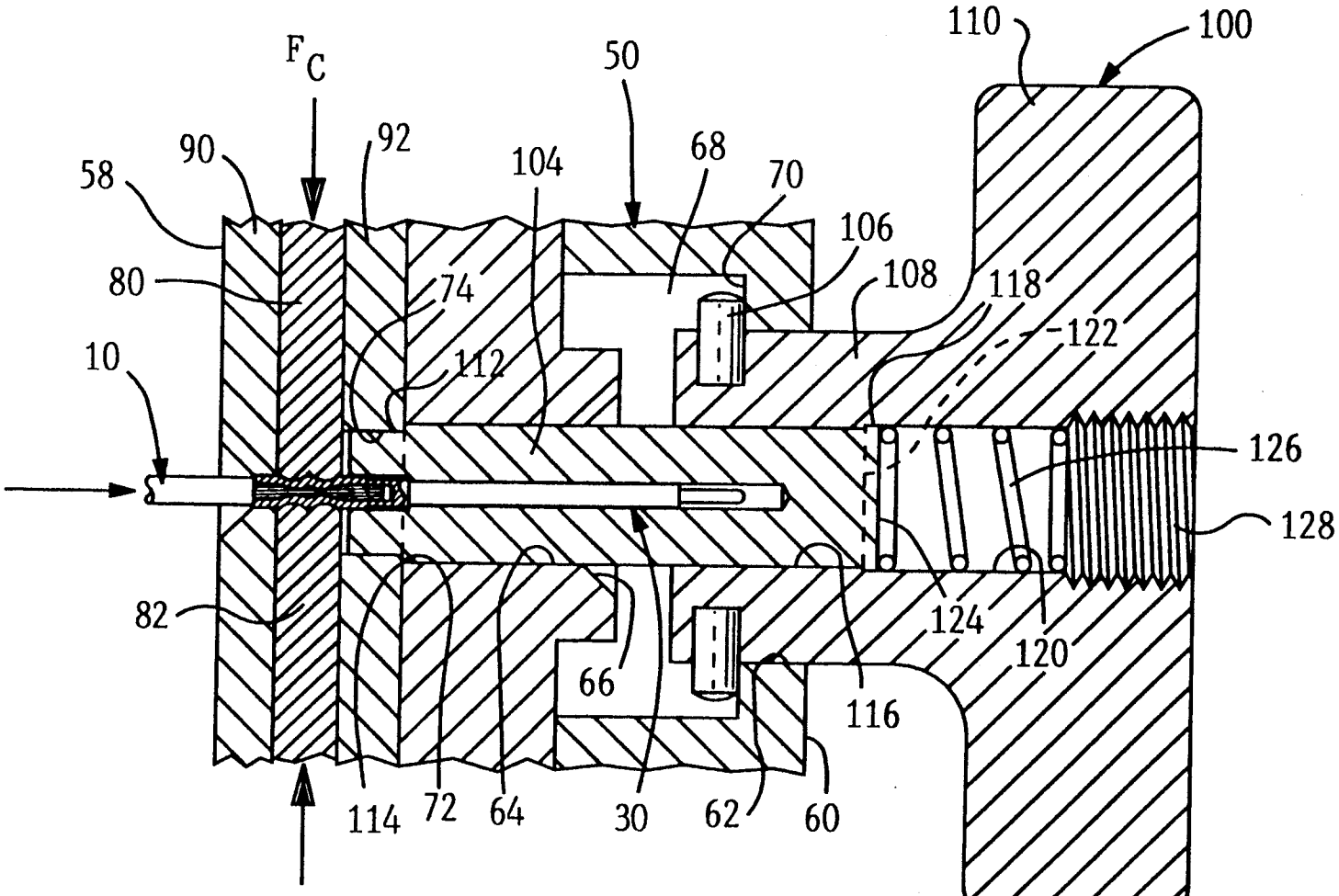
Figure 5:
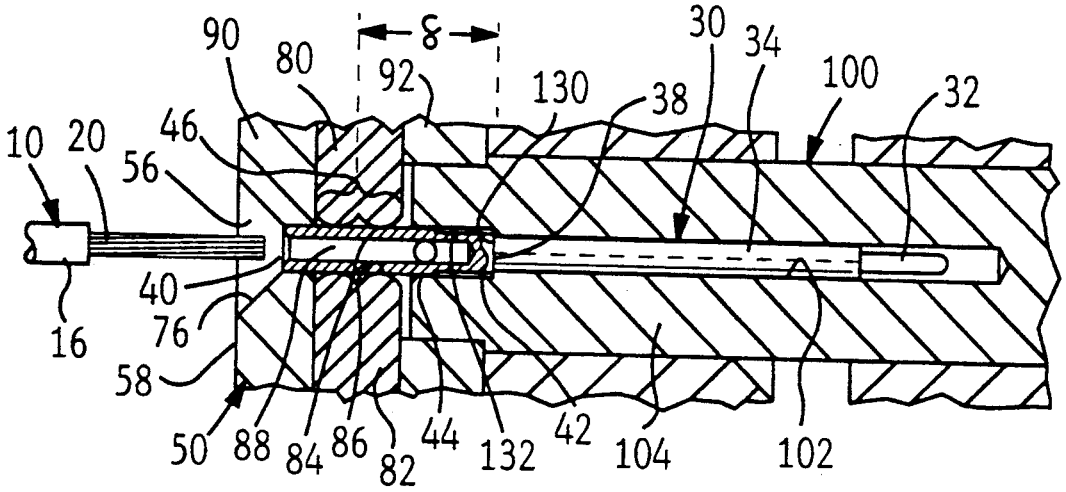
FIGS. 5 and 6 are enlarged longitudinal section views of the terminal and conductor within the fixture and tool of FIGS. 3 and 4 being crimped together.
Figure 6:
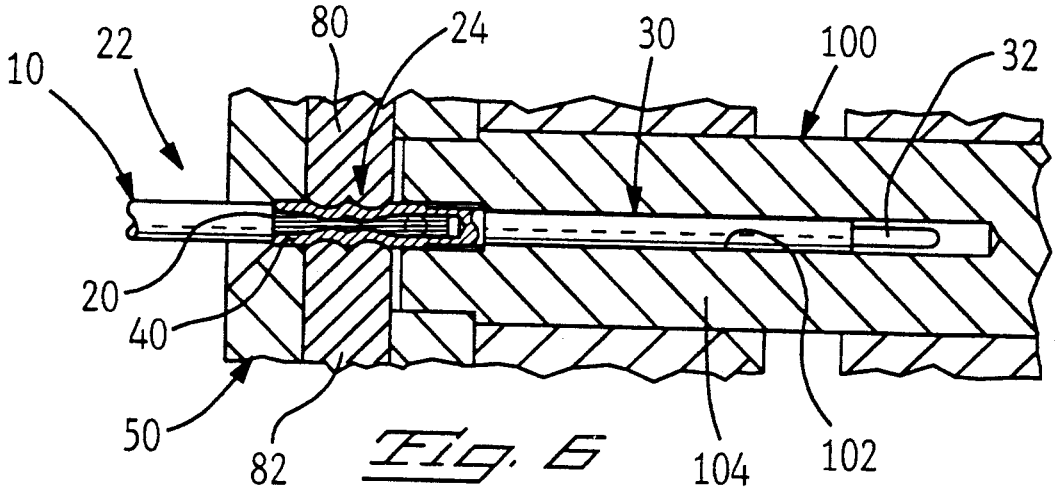

Electrical terminal 30 in FIGS. 1 and 2 includes a contact section 32 which is shown to comprise a pin, an elongate body section 34 extending rearwardly from pin contact section 32 to a conductor-receiving barrel 40 extending to rearward end 36 from an annular ledge 38 defined by forward portion 42 of barrel 40 having a larger outer diameter than elongate body section 34. A larger diameter rearward portion 44 of barrel 40 is seen, which is discussed hereinbelow. The portion of the conductor-receiving barrel to be crimped is designated as 46, and the portion of the terminal mating with a socket terminal is designated as 48. The length of intermediate section 42 is designated as L, the radius thereof is designated as $R_1$, and the radius of the remainder of barrel 40 is designated as $R_2$.

Crimping tool 50 is manually actuatable by squeezing handles 52,54 to cause crimping dies (FIGS. 3 to 6) secured therewithin at crimping port 56 to close against a terminal inserted thereinto from first side 58 until adjacent the crimping dies. It is preferred that the crimping dies are of the conventional arrangement wherein two pairs of opposed crimping dies provide pairs of indents at four equally spaced locations about the circumference of the conductor-receiving barrel of the terminal, known as a "4–8 indent crimp." Such a tool is commercially available and is identified as Part No. AFM8 (M22520/2-01) sold by Daniels Manufacturing Corp.

Locating fixture 100 is mountable to opposed second side 60 of tool 50 (see FIGS. 3 and 4) and opposed to crimping port 56, and includes a terminal-receiving aperture 102 extending through cylindrical shaft 104. Retention bosses 106 are shown extending radially outwardly from large-diameter body section 108 which secure locating fixture 100 to tool 50, and enlarged head 110 facilitates handling and gripping of locating fixture during manipulation thereof. A locating fixture generally like fixture 100 is available from Daniels Manufacturing Corp. and is identified as Part No. K996. Generally crimping tools and locating fixtures for use therewith are disclosed in Military Specification MIL-C-22520/2C dated Mar. 19, 1976.

Referring to FIGS. 3 to 6, locating fixture 100 has been affixed to crimping tool 50 opposed to crimping port 56, with cylindrical flange 104 disposed along crimping port 56 extending thereinto from second side 60. Terminal-receiving aperture 102 is aligned with crimping port 56 for receipt of a terminal thereinto to be crimped. During mounting of locating fixture 100, cylindrical shank 104 is inserted first through large aperture 62 and then into passage 64 through entrance 66 having a chamfered periphery defining a lead-in to facilitate insertion. Body section 108 is received through large aperture 62, and retention bosses 106 pass through complementarily-shaped keyways (not shown) and seated within cavity 68 when enlarged head 110 of locating fixture 100 is rotated, with retention bosses 106 abutting interior surface 70 to prevent backout.

Cylindrical shaft 104 includes a reduced-diameter forward section 112 defining a forwardly facing ledge 114 which abuts a corresponding rearwardly facing ledge 72 defined by a reduced-diameter forward portion 74 of passage 64 within which forward section 112 of shaft 104 is to be disposed. To assure that the forward section 112 is positioned fully forwardly within forward passage portion 74, cylindrical shaft 104 is incrementally movable within aperture 116 of body section 108 of fixture 100. Shaft 104 includes an annular collar 118 at its rearward end which is disposed within enlarged rearward aperture section 120, abutting rearwardly facing ledge 122 defined between rearward aperture section 120 and aperture 116 to retain shaft 104 assembled to fixture 100. Rear end 124 of shaft 104 is spring biasedly engaged by compression spring 126 mounted within rearward aperture section 120 and held therein by threaded insert 128. Spring 126 applies rearward force onto body section 108 upon abutment of forwardly facing ledge 114 with rearwardly facing ledge 72 within tool 50, thus assuring that retention bosses 106 are biased against interior surface 70 for frictional engagement therewith preventing inadvertent rotation of fixture and disengagement thereof from tool 50 while permitting intentional disassembly.

Crimping dies 80,82 are seen mounted within tool 50 and are reciprocally movable between plates 90,92 transversely toward and away from each other to move opposed crimping surfaces 84,86 thereof into and out of a crimping region 88 within which a target portion 46 of conductor-receiving barrel 40 of a terminal 30 is disposed for crimping, referring to FIGS. 3 to 6. Another pair of crimping dies (not shown) is disposed in the tool to be reciprocally movable along an axis at an angular distance of 90° from that of dies 80,82, thus striking the target portion 46 at 90° from the circumferential location struck by dies 80,82.

Terminal 30 is insertable into crimping port 56 with its contact section 32 forwardmost, entering conical entrance 76, passing between opposed crimping surfaces 84,86 of crimping dies 80,82, and entering contact-receiving passage 102. Terminal 30 becomes fully seated upon abutment of the forwardly-facing surface of annular collar 38 with precision stop surface 130 along passage 102. Precision stop surface 130 is defined between the main portion of passage 102 and larger-diameter forward portion 132 thereof. The diameter of forward passage portion 132 is carefully selected to be only as large as the nominal diameter of larger-diameter rearward portion 44 of conductor-receiving barrel 40 of terminal 30, with the axial length of reduced-diameter terminal portion 42 coincidently minimizing the amount of any slight interference fit of barrel 40 within passage 102 which could otherwise affect full seating of terminal 30 into locating fixture 100 determined by abutment of annular ledge 38 with precision stop surface 130. Full seating of terminal 30 within locating fixture 100 assures that target portion 46 of barrel 40 is precisely opposed from crimping surfaces 84,86 to be crimped to cable inner conductor 20 therewithin in accordance with the method of the present invention, using the improved locating fixture of the present invention.

Figure 7:
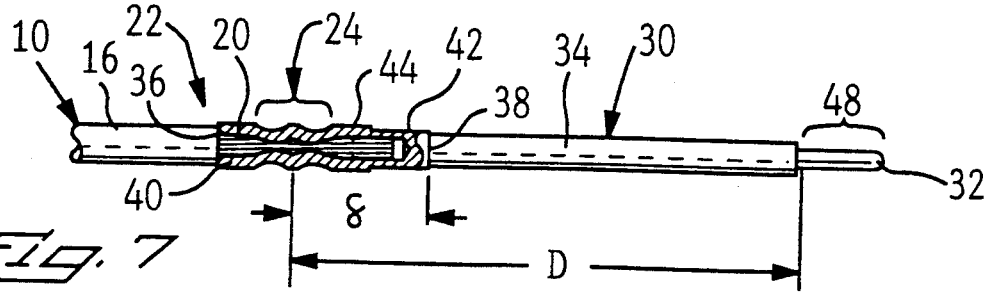
FIG. 7 is a view of the terminal crimped to the conductor of the coaxial cable.

A crimped connection 22 is shown in FIG. 7, illustrating crimp joint 24 affixing and electrically connecting terminal 30 to inner conductor 20 of coaxial cable 10. Crimp joint 24 has been defined by crimping surfaces 80,82 precisely at target portion 46 of barrel 40. Target portion 46, and hence crimp joint 24, has been optimally located a desired distance from contact section 32. The center of crimp joint 24 has been precisely located a distance $\delta$ rearwardly from the forwardly facing surface of annular ledge 38, and has been located a distance D from the inward end of the mating range 48 along the length of contact section 32. The improvement to an otherwise conventional locating fixture 100 to enable such precision location of the ultimate crimp joint, is provided to correspond with the particular size and design of terminal with which it is to be used, and is provided by defining precision stop surface 130 with respect to the centerlines of the crimping surfaces 84,86 of crimping dies 80,82 of conventional crimping tool 50, given abutment of forwardly facing ledge 114 along cylindrical shaft 104 with rearwardly facing ledge 72 of passage 64,74.

For example, for a pin contact terminal, the contact sections 32 have a length of about 0.070 inches, and for a complementary mating socket contact terminal, its contact section can also have a length of 0.070 inches; body sections 34 are 0.297 inches long; conductor-receiving barrels 40 are about 0.1235 inches long. It has been determined that the optimum position of the ultimate crimp joint along barrel 40 begins 0.478 inches from the inward extent of the mating portion of contact section 32. Therefore, having ascertained the precise distance from crimping dies 80,82 of tool 50 at which locating fixture 100 will be located upon routine mounting by abutment of fixture ledge 114 with tool ledge 72, precision stop surface 130 is defined along passage 102 at a location which will be disposed a distance of 0.111 inches from the centerlines of crimping surfaces 84,86 of crimping dies 80,82 within tool 50, upon mounting of locating fixture 100 to crimping tool 50. The shape of the crimping die surfaces of each pair of dies is shown as opposed axially-spaced pairs of arcuate transverse embossments which will effect opposed axially-spaced pairs of transverse depressions into the outer surface of barrel 40, resulting in corresponding rounded transverse depressions into the inner conductor 20 of cable 10 which has been determined is an acceptable deformation of the conductor with minimized reflection generated thereby during signal transmission.

Figure 8:
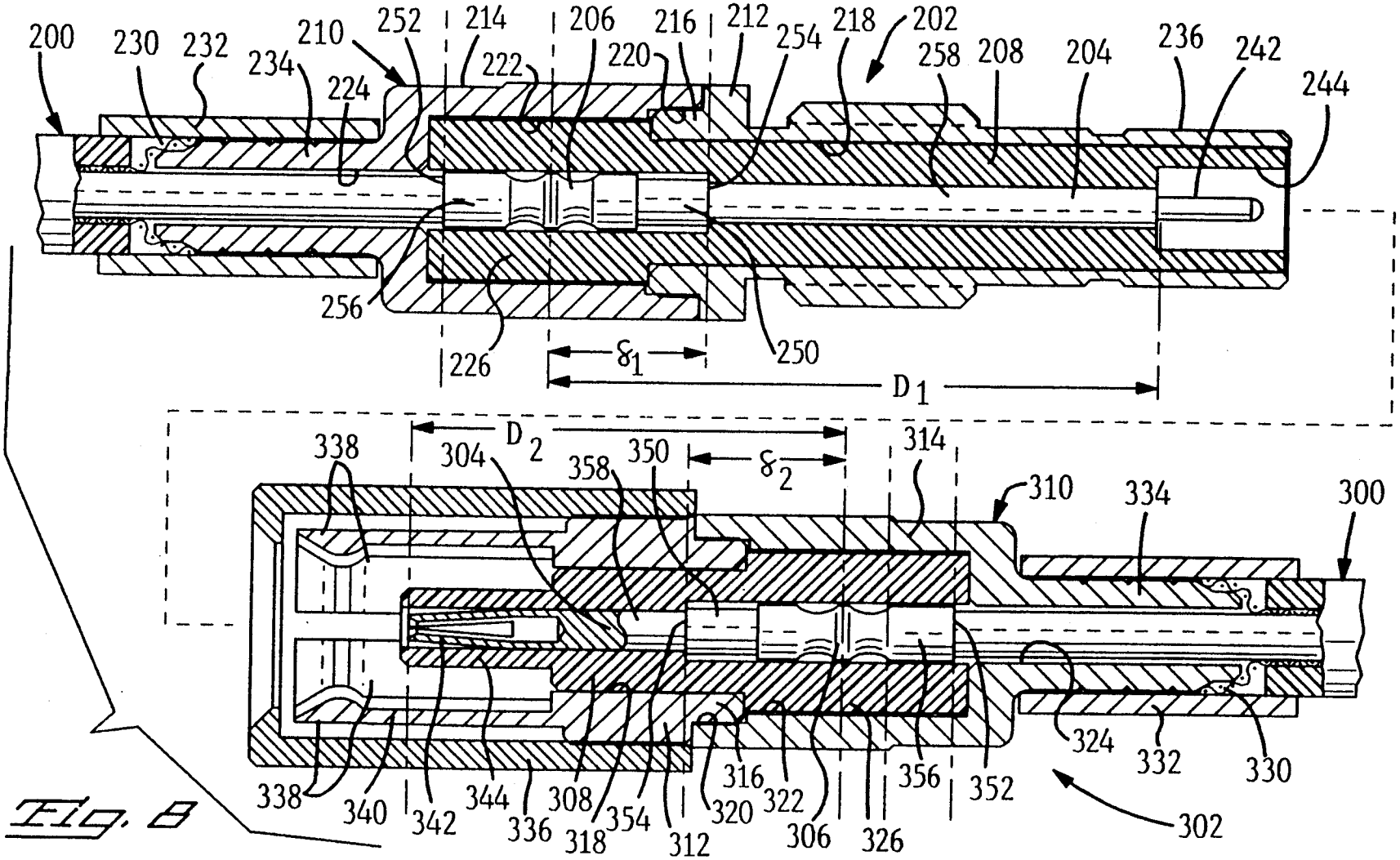
FIGS. 8 and 9 are longitudinal section views of the coaxial having the thus-terminated inner conductor disposed within a coaxial connector about to be mated, and then fully mated, to a complementary coaxial connector also having a complementary terminal crimped to the inner conductor of an associated coaxial cable, defining a mated coaxial connection.
Figure 9:
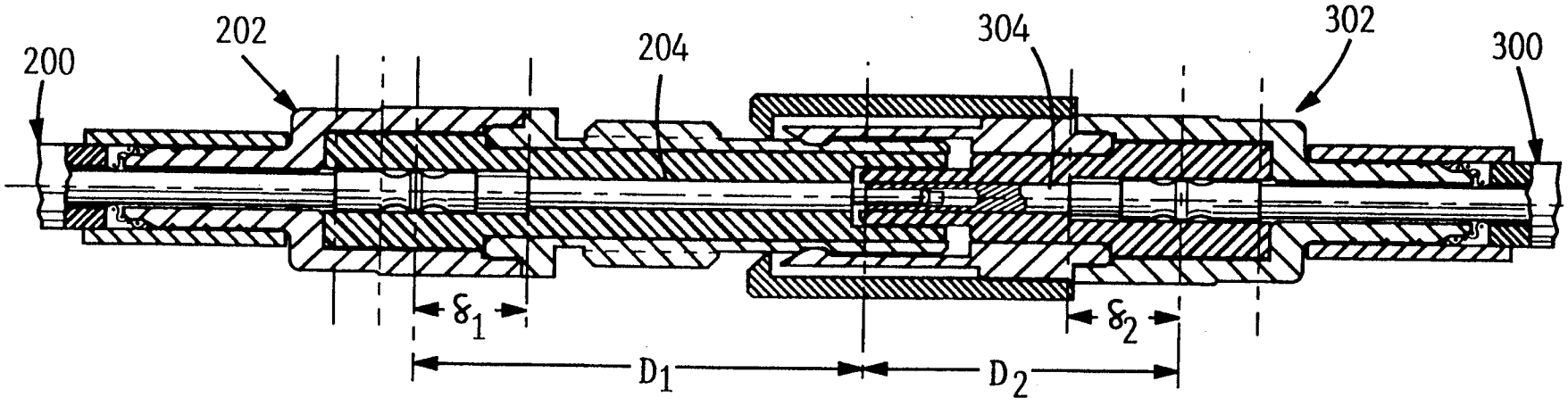

FIGS. 8 and 9 illustrate a pair of coaxial cables 200,300 having matable connectors 202,302 affixed thereon, terminated to ends thereof. Connectors 202,302 include terminals 204,304 crimped to inner conductors thereof at crimp joints 206,306 in accordance with the method and apparatus of the present invention; also seen are indents defined by the pair of crimping dies at 90° to dies 80,82.

Connectors 202,302 also include dielectric sleeves 208,308 within which are retained the terminations defined by terminals 204,304 to inner conductors 206,306. Outer conductive shells 210,310 of the connectors are mounted about the dielectric sleeves 208,308 and are shown to be of two interfitting shell members 212,214;312,314 press fit together about sleeves 208,308 and are concentric with the inner conductors and terminals. Forward shell members 212,312 include annular flanges 216,316 extending axially rearwardly adjacent the sleeve receiving bore 218,318 to be received in press fit within recesses 220,320 of rearward shell members 214,314 having a larger diameter sleeve-receiving bore section 222,322 forwardly of smaller diameter cable-receiving bore section 224,324, the arrangement thus defining a sleeve retention system in cooperation with larger diameter rearward section 226,326 of sleeves 208,308.

Outer shells 210,310 are electrically connected to shielding braids 230,330 of cables 200,300 such as by crimping of crimping ferrules 232,332 compressing the braids against rear extensions 234,334 of the outer shells, for cable grounding. Additionally connector 302 is shown to have a protective hood 336 surrounding socket contact section 340 defined on forward shell member 312 which mates with forward male section 236 of forward shell member 212 of connector 202 with cantilever beam spring arms 338 biased outwardly by forward section 236 upon mating to establish an assured ground connection between the outer conductive shells of the connectors.

Referring to FIGS. 8 and 9, inner terminal 304 includes a socket contact section 342 enshrouded within a plug section 344 of dielectric sleeve 308, while inner terminal 204 includes a pin contact section 242 such as of terminal 30 of FIGS. 1 to 7, enshrouded within a receptacle section 244 of dielectric sleeve 208 of large enough diameter to receive thereinto plug section 344 of sleeve 308 of connector 302 during connector mating. Crimp joints 206,306 are disposed spaced axially rearwardly from the region of mated interconnection of pin contact section 242 with socket contact section 342, a distance $D_1$ along terminal 204 of connector 202 and $D_2$ along terminal 304 of connector 302, selected to minimize reflection and resultant impedance mismatch in cooperation with precisely located and dimensioned intermediate contact sections 250,350.

Figure 10:
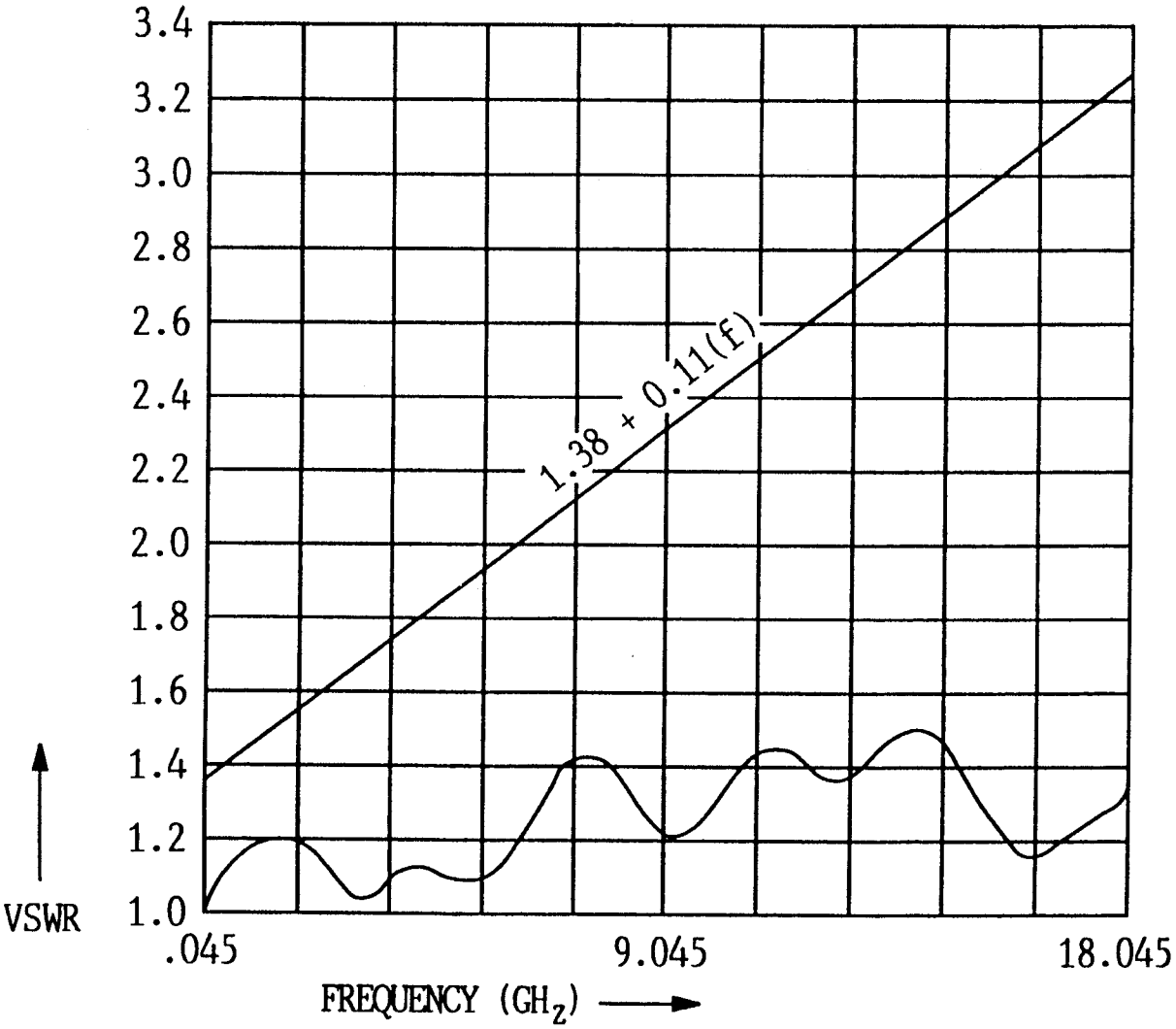
FIG. 10 is a graphic representation of the reflection loss of the mated coaxial connection of FIG. 8.

FIG. 10 is a graphic representation of the expected performance of the connector assembly of FIG. 9 assessing impedance mismatch, in terms of VSWR (voltage standing wave ratio) versus frequency in gigahertz. The straight line graph is a graphic representation of the formula $$Max\ VSWR = 1.38 + (0.11 \times F)$$

where

F = frequency in Gigahertz

This formula represents performance which would be considered acceptable in the industry for a single-line mated pair of matable and unmatable coaxial connectors of the general type illustrated. The representation of the expected performance is superior to the acceptable level.

An example of such a coaxial connector assembly would be as follows: cables 200 and 300 include an inner conductor having a diameter of 0.012 inches; pin contact terminal 202 has a body section length of 0.771 inches while socket terminal 302 has a body section length of 0.681 inches; pin terminal 202 and socket terminal 302 can both have conductor-receiving barrels with inner diameters of 0.0175 inches and lengths of 0.150 inches from rearward ends 252,352 to annular ledges 254,354. Distances $\delta_1$ and $\delta_2$ are selected to both be 0.111 inches. In the mated connector assembly, the nominal mating point is considered the forwardmost engagement of socket contact section 330 with pin contact section 230, which is the point where the forward ends of the socket contact's arms are in spring biased engagement with the pin contact, which for pin terminal 202 becomes $D_1 = 0.420$ inches from the center of crimp joint 206, while the nominal effective mating point for socket terminal 302 becomes $D_2 = 0.296$ inches from the center of crimp joint 306. Both crimp joints having axial lengths of 0.070 inches with the centers thereof spaced 0.0305 inches from rearward terminal ends 252,352 incrementally forwardly of where outer conductors 210,310 have substantially reduced inner diameters of 0.038 inches to extend along the inner insulative jackets of cables 200,300 respectively.

Using FIG. 2 as a guide, the outer diameter of the conductor-receiving barrels 256,356 is $2R_2 = 0.036$ inches for both terminals. The impedance compensation or stepped intermediate sections 250,350 have an outer diameter of $2R_1 = 0.030$ inches for an axial length of 0.047 inches for both terminals. Body sections 258,358 may have an outer diameter of 0.026 inches for the socket terminal 302 and 0.0145 inches for the pin terminal 202.

Referring to FIG. 8, the inner diameter of the sleeve-receiving bores 218,318 of both forward conductive shell members 212,312 is preferably 0.083 inches, and the sleeve-receiving bore portions 222,322 of both rearward conductive shell members 214,314 is preferably 0.110 inches.

While the particular size and dimension of pin or socket terminal may vary according to the particular gage coaxial cable to be terminated, the method of the present invention can be practiced therewith by defining an impedance compensating or intermediate section of each such terminal of precisely selected length, diameter and location along the terminal and defining the stop surface adjacent the body section to be used for positioning during crimping. The method includes correspondingly varying the diameter of the locating fixture and varying the precise location of the precision stop surface which will abut the stop surface of the terminal to assure that the crimping dies of the tool will generate a crimp joint which will ultimately upon connector mating be located a precise known distance from the effective mating point in a mated connector assembly. Selecting an axial length and outer diameter and location of the reduced diameter intermediate sections for the size terminals selected to achieve deliberate impedance mismatch at the intermediate section to compensate for mismatch of the remainder of the connection, in cooperation with referencing the crimp joint location thereto, and carefully selected design aspects of the remaining parts of the connector in which the terminated cable end is disposed, all results in satisfactorily overall minimized impedance mismatch and signal degradation for the connection. This method assures routine quality crimp joints of novel signal terminals to inner conductors of coaxial cables, in a simple crimping procedure with minimized technique sensitivity, to assure production of a crimp joint of satisfactory impedance performance and minimal signal degradation.

We claim:

1. A coaxial connector for a coaxial cable of known diameter and having an inner conductor terminated to a signal terminal having a conductor-receiving barrel of known length and diameter, an intermediate section forwardly thereof of smaller diameter and concluding at a forwardly facing ledge at a selected axial location, a body section forwardly thereof of still smaller diameter and of known length, and a contact section extending from a forward end thereof adapted to mate with a complementary contact section of a terminal of a mating connector, the coaxial cable being prepared with a length of shielding braid exposed forwardly of the outer jacket and a length of the insulated conductor extending forwardly thereof to said terminal terminated onto the inner conductor, comprising:

forward and rearward outer conductive shell members, a dielectric sleeve and a crimping ferrule;

said dielectric sleeve having a profiled terminal-receiving passageway extending centered therethrough from a rearward end to a forward end, said dielectric sleeve having a body section of selected diameter, a forward section having a diameter not exceeding that of said body section extending from said body section thereof to coextend along said contact section adapted to mate with a complementary forward section of a dielectric sleeve of a mating connector coextending along said complementary contact section, and said dielectric sleeve including a rearward section having a diameter larger than the diameter of said body section and defining a forwardly facing ledge;

said dielectric sleeve having a forward portion of said passageway dimensioned just large enough to receive thereinto and therethrough said body section of said terminal, and having a rearward portion of said passageway of larger diameter than said forward portion dimensioned just large enough to receive thereinto said intermediate section and said conductor-receiving barrel of said terminal, a rearwardly facing stop surface being defined between said forward and rearward passageway portions cooperable with said ledge of said terminal to define full terminal insertion with said intermediate section disposed in said rearward passageway portion;

said forward shell member including a sleeve-receiving bore therethrough from a front end to a rearward end and having a diameter just large enough to permit placement over said forward section and said body section of said dielectric sleeve, said forward shell member including a forward section adapted to mate with a complementary forward section of a mating coaxial connector to define a ground connection therewith, and said forward shell member including a rearward section of enlarged outer diameter and short axial length and including an annular flange extending axially therefrom adjacent said sleeve-receiving bore and having an outer diameter less than said enlarged outer diameter and abutting said forwardly facing ledge of said dielectric sleeve upon full sleeve insertion thereinto, said annular flange having an axial length just less than the axial length of said intermediate section of said terminal; and said rearward shell member having a sleeve-receiving bore extending into a front end thereof a selected distance and a reduced-diameter cable-receiving bore extending thereinto from a rear end thereof communicating with said sleeve-receiving bore, said rearward shell member including a rearward section having a reduced outer diameter approximating the cable outer diameter, and having a forward section having a diameter selected to equal the diameter of said enlarged section of said forward shell member;

said rearward shell member including a recess into said front end having a diameter and axial length selected to receive thereinto said annular flange of said forward shell member in a press fit, with said sleeve-receiving bore section having an axial length for said rearward sleeve section to be disposed therewithin when said forward and rearward shell members are interfitted together over corresponding ends of said dielectric sleeve, thus trapping said sleeve therewithin to define a subassembly ready to receive said prepared cable end insertably thereinto from a rear face thereof; and said crimping ferrule dimensioned to be superposed over said rearward section of said rearward shell member after said terminated cable end has been inserted and said shielding braid disposed over said rearward section, and then crimped thereonto defining a ground connection between said coaxial cable and said rearward shell while extending over a portion of the outer jacket of the coaxial cable adjacent the prepared end.

2. The coaxial connector of claim 1 wherein said terminal includes a pin contact section, said forward end of said dielectric sleeve defining a shroud around said pin contact section spaced radially therefrom to receive a plug-shaped complementary sleeve forward end of a mating connector, and said forward end of said forward shell member defining a plug section adapted to be received into a socket-shaped complementary shell forward end of said mating connector.

3. The coaxial connector of claim 1 wherein said terminal includes a socket contact section, said forward end of said dielectric sleeve defining a plug section adjacent said socket contact section adapted to be received into a receptacle-shaped complementary sleeve forward end of a mating connector, and said forward end of said forward shell member defining a socket section having cantilever beam spring arms extending beyond said forward end of said dielectric sleeve to receive thereinto a plug-shaped complementary shell forward end of said mating connector.

4. The coaxial connector of claim 3 further including a protective hood extending around and forwardly of said socket section and affixed to said forward shell member.

5. An improved coaxial connector for a coaxial cable and adapted to receive therein a terminal-terminated end of the cable during termination to the cable, the coaxial cable being of known diameter and having an inner conductor terminated to a signal terminal having a conductor-receiving barrel of known length and diameter, an intermediate section forwardly thereof of smaller diameter and concluding at a forwardly facing ledge at a selected axial location and defining an impedance compensating section, a body section forwardly thereof of still smaller diameter and of known length, and a contact section extending from a forward end thereof adapted to mate with a complementary contact section of a terminal of a mating connector, the connector having an outer conductive shell within which is disposed a dielectric sleeve and altogether adapted to receive a terminal-terminated cable end thereinto with a contact section of the terminal exposed at a forward end for mating with a complementary contact section of a mating connector, with the outer conductive shell adapted to be groundingly connected to a shielding braid of the cable, the improvement comprising:

said outer conductive shell having a forward portion generally along the body section of the terminal and a rearward portion generally along the conductor-receiving barrel of the terminal, upon insertion of the terminated cable end into the connector, said forward portion being of selected diameter and said rearward portion having a diameter selected to be larger than that of said forward portion joining at an axial location selected for said intermediate section of said terminal to be substantially entirely disposed in said forward portion upon full insertion into a terminal-receiving passageway of said dielectric sleeve and abutting a stop surface therealong at a preselected position, and thus complementing the intermediate terminal section to generate a region of deliberate impedance mismatch to compensate for the impedance mismatch of the remainder of the coaxial connector during in service use and minimize the impedance mismatch of the total connector.

6. An improved coaxial connector for a coaxial cable of known diameter and having an inner conductor and a shielding braid, the connector being of the type including a signal terminal having a conductor-receiving barrel of known length and diameter, a body section forwardly thereof of still smaller diameter and of known length, and a contact section extending from a forward end thereof adapted to mate with a complementary contact section of a terminal of a mating connector, the connector having an outer conductive shell within which is disposed a dielectric sleeve and altogether adapted to receive a terminal-terminated cable end thereinto with a contact section of the terminal exposed at a forward end for mating with a complementary contact section of a mating connector, with the outer conductive shell adapted to be groundingly connected to the shielding braid of the cable, the improvement comprising:

said terminal including an intermediate section rearwardly of said body section and defining a forward portion of said conductor-receiving barrel and having a diameter smaller than the diameter of said conductor-receiving barrel and larger than the diameter of said body section, said intermediate section concluding at a forwardly facing ledge at a selected axial location and defining an impedance compensating section; and said outer conductive shell having a forward portion generally along the body section of the terminal and a rearward portion generally along the conductor-receing barrel of the terminal, upon insertion of the terminated cable end into the connector, said forward portion being of selected diameter and said rearward portion having a diameter selected to be larger than that of said forward portion joining at an axial location selected for said intermediate section of said terminal to be substantially entirely disposed in said forward portion upon full insertion into a terminal-receiving passageway of said dielectric sleeve and abutting a stop surface therealong at a preselected position, and thus complementing the intermediate terminal section to generate a region of deliberate impedance mismatch to compensate for the impedance mismatch of the remainder of the coaxial connector during in-service use and minimize the impedance mismatch of the total connector.

* * * * *